United States Patent [19]

Spehrley, Jr.

[11] 4,175,314

[45] Nov. 27, 1979

[54] PNEUMATICALLY CONTROLLED STAPLING SYSTEM

[75] Inventor: Charles W. Spehrley, Jr., Quechee, Vt.

[73] Assignee: Xerox Corporation, Stamford, Conn.

[21] Appl. No.: 901,929

[22] Filed: May 1, 1978

[51] Int. Cl.[2] ..... B25C 7/00

[52] U.S. Cl. ..... 29/432.1; 227/153

[58] Field of Search ..... 29/432, 432.1; 227/152, 227/153, 154, 155

[56] References Cited

U.S. PATENT DOCUMENTS

| | | | |
|---|---|---|---|
| 3,474,947 | 10/1969 | Readyhough | 227/108 |
| 3,557,442 | 1/1971 | Speller | 227/153 X |
| 3,685,712 | 8/1972 | Turner et al. | 227/3 |

*Primary Examiner*—Paul A. Bell

*Attorney, Agent, or Firm*—J. J. Ralabate; C. A. Green; H. Fleischer

[57] ABSTRACT

An apparatus in which at least two sheets are stapled to one another. The apparatus includes a controller which places a pressure source in communication with a staple drive so that pressurized fluid actuates the staple drive to drive a staple through the sheets. Thereafter, the controller places the staple drive in communication with a staple clincher so that the pressurized fluid exhausting from the staple drive actuates the staple clincher to clinch the portion of the staple legs protruding through the sheets.

14 Claims, 3 Drawing Figures

PNEUMATICALLY CONTROLLED STAPLING SYSTEM

The foregoing abstract is neither intended to define the invention disclosed in the specification, nor is it intended to be limiting as to the scope of the invention in any way.

BACKGROUND OF THE INVENTION

This invention relates generally to an electrophotographic printing machine, and more particularly concerns an apparatus for stapling sets of copy sheets reproduced from a set of original documents.

Typically, an electrophotographic printing machine may reproduce a plurality of booklets or sets of copies. Each set of copies corresponds to the set of original documents. The copies of each set are secured to one another by a stapling apparatus. The stapling apparatus accepts each set and then drives staples through all of the copy sheets in the set to form finished booklets.

Various types of stapling systems have been devised for use with electrophotographic printing machines. For example, the stapler may be actuated electronically. In this type of a system, the set trips a sensor which then actuates a solenoid for driving the staple therethrough. Alternatively, a hydraulic system may also be employed. In a hydraulic system, a ram, driven hydraulically, drives the staple through the set of sheets. A pneumatic system, which is air actuated, is essentially the same as a hydraulic system with a compressible gas rather than a liquid being employed. Finally, a mechanical system wherein the staple is driven by a driver mechanically actuated, has also hereinbefore been utilized in conjunction with electrophotographic printing machines. In all of the foregoing systems, power is a significant requirement and the reduction thereof highly desirable. Furthermore, the hardware and complexity of the mechanism associated with the stapling system increases the cost of the printing machine. It has been found that a pneumatic system may be the least expensive and complex of the foregoing devices provided that it is designed with a view to minimizing cost and complexity.

Accordingly, it is a primary object of the present invention to improve the stapling apparatus employed in an electrophotographic printing machine.

PRIOR ART STATEMENT

Various types of devices have hereinbefore been developed to improve stapling sets of copy sheets reproduced in an electrophotographic printing machine. The following prior art appears to be relevant:

Readyhough, U.S. Pat. No. 3,474,947, Oct. 28, 1969;
Turner et al., U.S. Pat. No. 3,685,712, Aug. 22, 1972.

The pertinent portions of the foregoing prior art may be briefly summarized as follows:

Readyhough describes a piston and cylinder unit for moving a stapling device toward and away from the work piece. A fluid pressure control circuit is operable to effect movement of the stapling device toward the work piece by establishing a predetermined pressure differential across the piston. This pressure changes due to the engagement of the stapling device with the work piece. The pressure change actuates the stapling device to effect a stapling and clinching operation. Thereafter, the stapling device returns to its original position.

Turner et al., discloses a stapling apparatus for stapling sets of copy sheets into booklets. The sets of copy sheets are reproduced on an electrophotographic printing machine by the repeated copying of the original documents.

It is believed that the scope of the present invention, as defined by the appended claims, is patentable distinct over the foregoing prior art taken either singly or in combination with one another.

SUMMARY OF THE INVENTION

Briefly stated, and in accordance with the present invention, there is provided an apparatus for stapling at least two sheets to one another.

Pursuant to the features of the invention, the apparatus includes means for driving a staple through the sheets. Means are provided for clinching the portion of the staple legs protruding through the sheets. Control means place a source of pressurized fluid in communication with the driving means. This actuates the driving means. Thereafter, the control means places the driving means in communication with the clinching means so that the pressurized fluid exhausting from the driving means actuates the clinching means.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
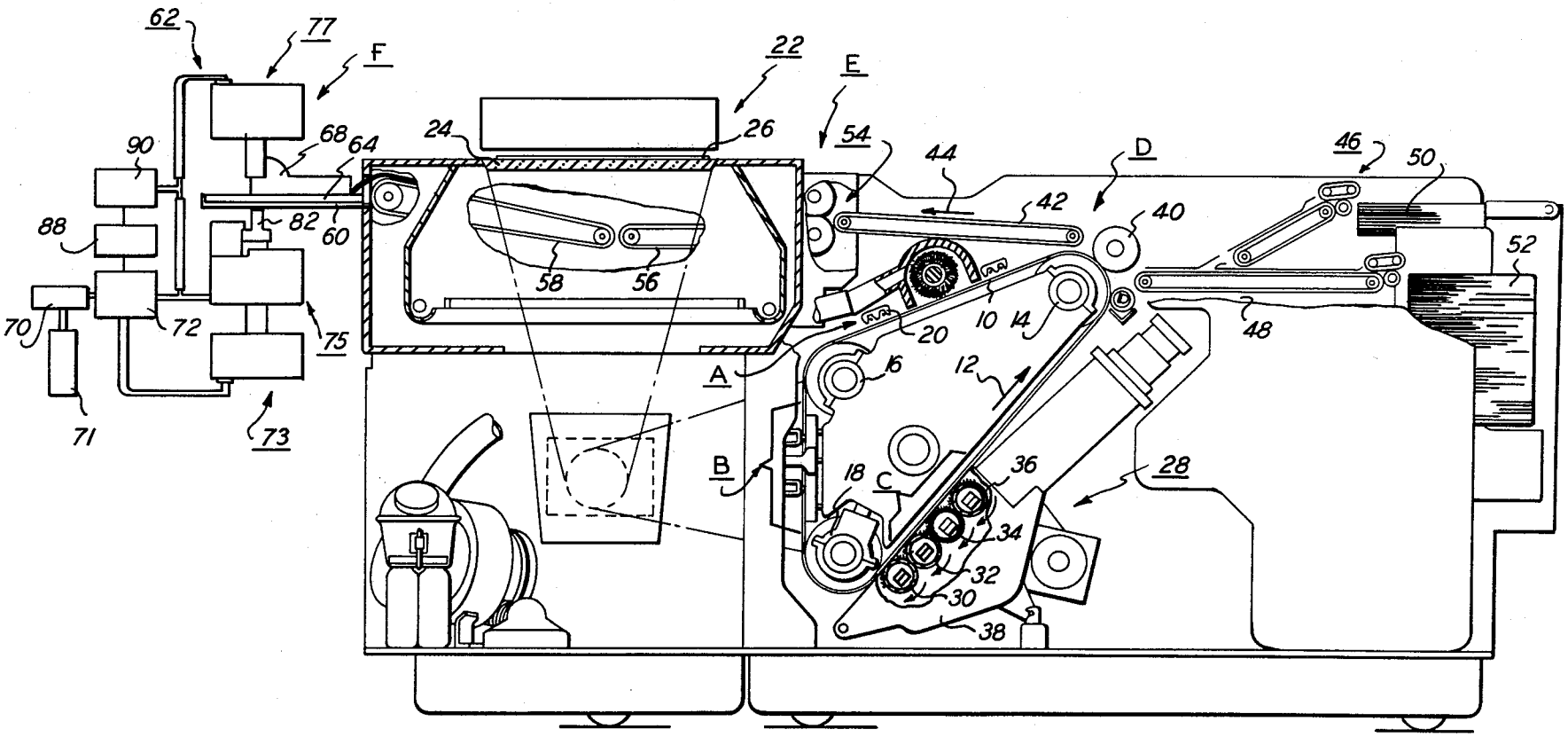
FIG. 1 is a schematic elevational view showing an electrophotographic printing machine incorporating the features of the present invention therein.

For a general understanding of the illustrative electrophotographic printing machine incorporating the features of the present invention therein, reference is made to the drawings. In the drawings, like reference numerals have been used throughout to designate identical elements. FIG. 1 schematically illustrates the various components of an electrophotographic printing machine employing the stapling apparatus of the present invention therein. Although the stapling apparatus is particularly well adapted for use in an electrophotographic printing machine, it will become evident from the following discussion that it is equally well suited for use in a wide variety of devices and is not necessarily limited in its application to the particular embodiment shown herein.

Inasmuch as the art of electrophotographic printing is well known, the various processisng stations employed in the FIG. 1 printing machine will be shown hereinafter schematically and their operation described briefly with reference thereto.

As shown in FIG. 1, the electrophotographic printing machine employs a belt 10 having a photoconductive surface, e.g., a selenium alloy, deposted on a conductive substrate, e.g., aluminum. Belt 10 moves in the direction of arrow 12 to advance sequentially through the various processing stations disposed about the path of movement thereof. Rollers 14, 16 and 18 support belt 10. A drive mechanism, i.e., a suitable motor is coupled to roller 14 and it drives belt 10 in the direction of arrow 12.

Initially, a portion of belt 10 passes through charging station A. At charging station A, a corona generating device, indicated generally by the reference numeral 20, charges the photoconductive surface of belt 10 to a relatively high, substantially uniform potential. A suitable corona generating device is described in U.S. Pat. No. 2,836,725 issued to Vyverberg in 1958.

Thereafter, the charged portion of photoconductive belt 10 advances through exposure station B. At exposure station B, a recirculating document handling system, indicated generally by the reference numeral 22, serially feeds the individual pages of a multi-page document from a supply tray to transparent platen 24. Original document 26 is positioned faced down upon platen 24. After original document 26 is exposed, it is returned to the supply tray in recirculating document handling systems 22 for removal therefrom or for subsequent re-feeding. A suitable recirculating document handling system is described in U.K. Pat. No. 1,492,466 by Russel and published on Nov. 23, 1977. The relevant portions of the foregoing patent are hereby incorporated into the present application.

Exposure station B includes a lamp for flashing light rays upon original document 26. The light rays reflected from original document 26 pass through the optics of exposure station B forming a light image containing the informational areas of the original document therein. The optics, e.g., a suitable lens and mirrors, of exposure station B project the light image onto the charged portion of belt 10. In this manner, the charged photoconductive surface of belt 10 is discharged selectively by the light image of the original document. This records an electrostatic latent image on the photoconductive surface of belt 10 which corresponds to the informational areas contained within original document 22.

Belt 10 next advances the electrostatic latent image recorded thereon to development station C. At development station C, developer unit 28 includes a plurality of magnetic brush developer rollers 30, 32, 34 and 36 disposed in housing 38. These developer rollers advance the developer mix into contact with the electrostatic latent image recorded on photoconductive surface belt. The developer mix comprises carrier granules having toner particles adhering triboelectrically thereto. Preferably, the carrier granules are formed from a ferromagnetic material while the toner particles are made from a heat settable plastic. In a magnetic brush development system of this type, a chain-like array of developer mix extends in an outwardly direction from each developer roller to contact the electrostatic latent image recorded on the photoconductive surface of belt 10. The latent image attracts the toner particles from the carrier granules forming a toner powder image on belt 10.

Belt 10 advances the toner powder image to transfer station D. Transfer station D is located at point of tangency on belt 10 as it moves around roller 14. A transfer roller 40 is disposed at transfer station D with a copy sheet being interposed between transfer roller 40 and belt 10. Transfer roller 40 is electrically biased to a suitable magnitude and polarity so as to attract the toner powder image from belt 10 to the surface of the copy sheet in contact therewith. After transferring the toner powder image to the copy sheet, conveyor 42 advances the copy sheet in the direction of arrow 44 to fixing station E.

Prior to proceeding with the discussion of fixing station E, sheet feeding apparatus 46 will be discussed briefly. Sheet feeding apparatus 46 includes a transport 48 which advances, in seriatim, successive copy sheets from stack 50, or, in lieu thereof, stack 52. The machine programming enables the operator to select the desired stack from which the copy sheet will be advanced. The selected copy sheet is advanced to transfer station D where the toner powder image adhering to the photoconductive surface of belt 10 is transferred thereto.

Conveyor 42 advances the copy sheet with the toner powder image thereon, in the direction of arrow 44, to fixing station E.

At fixing station E, a fuser assembly, indicated generally by the reference numeral 54, comprises a heated fuser roll and a back-up roll. The copy sheet having the toner powder image thereon passes between the fuser roll and back-up roll with the toner powder image contacting the fuser roll. In this manner, the toner powder image is permanently affixed to the copy sheet. After fusing, conveyors 56 and 58 advance the copy sheet to finishing station F. Finishing station F includes a receiving tray 60 and a stapling apparatus, indicated generally by the reference numeral 62. Tray 60 is adjustable for various paper width. Copy sheets are received in tray 60 and when a complte set, i.e., corresponding to all of the original documents being reproduced, is contained therein, stapling apparatus 62 is actuated to form a set or booklet thereof. While only one tray and stapling apparatus is depicted in FIG. 1, one skilled in the art will appreciate that a plurality of such trays may be employed therein so as to contain a plurality of sets wherein each set corresponds to all of the original documents being reproduced. In this manner, stapling apparatus 62 secures the copy sheets within each set forming collated booklets. The detailed structure of stapling apparatus 62 will be described with reference to FIG. 2.

It is believed that the foregoing description is sufficient for purposes of the present application to illustrate the general operation of an electrophotographic printing machine incorporating the features of the present invention therein. Referring now to the specific subject matter of the present invention, FIG. 2 depicts the stapling apparatus, in detail, employed in the FIG. 1 printing machine.

Figure 2:
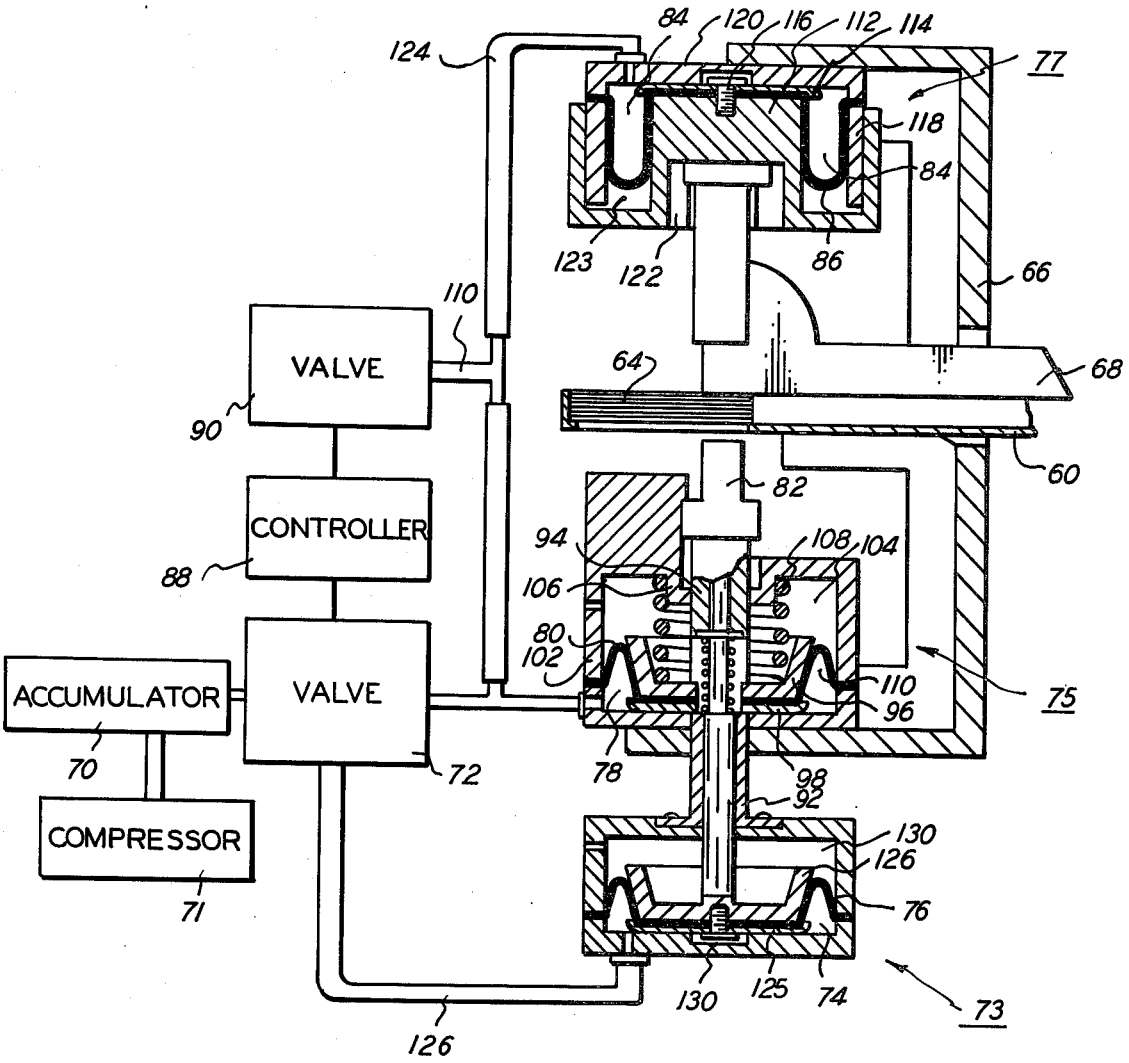
FIG. 2 is a schematic elevational view depicting the stapling apparatus employed in the FIG. 1 printing machine.

Referring now to FIG. 2, there is shown the detailed structure of stapling apparatus 62. As is shown therein, a stack of copy sheets 64 is positioned in tray 60 so as to be secured to one another. Stapling apparatus 62 includes a frame 66 having a stapling head 68 secured rigidly thereto. A source of pressurized fluid or air is generated by compressor 71 and stored in accumulator 70. Accumulator 70 is coupled to the input port of a three-way solenoid valve 72. Valve 72 has an output port which is connected to chamber 74 of housing 73. Housing 73 is divided into chambers 74 and 130 by a flexible diaphragm 76. Another output port of valve 72 is coupled to chamber 78 of housing 75. Housing 75 is divided into chambers 74 and 104 by a flexible diaphragm 80. The flow of pressurized fluid into chamber 78 causes diaphragm 80 to expand driving piston 82 into engagement with stack of copy sheets 64 clamping them into position. The output port coupled to the chamber 74 is also connected to chamber 84 of housing 77. Housing 77 is divided into chambers 84 and 123 by a flexible diaphragm 86. The flow of pressurized air into chamber 84 causes diaphragm 86 to expand actuating the driver of stapling head 68 so as to drive staples through the clamped set of copy sheets. Thereafter, controller 88 actuates valve 72 to close the input port and open both of the output ports. In this manner, the pressurized air from exhausts from chambers 84 and 78 into chamber 74 of housing 73. This expands diaphragm 76 causing it to drive clinching piston into engagement with the portion of the stapled legs protruding through the stack of sheets 64 clinching the stapled legs. The act of clinching requires that the stapled legs be folded over and into engagement with the stack of copy sheets. In this manner, the stack of copy sheets is secured to one another.

In operation, controller 88 switches valve 72 between two states. In a first state, accumulator 70 provides a flow of pressurized air through the output ports to sequentially activate the clamper and staple driver. In a second state, the input port of valve 72 is closed and the pressurized air in the chamber associated with the clamper and staple driver is exhausted through the output ports to activate the staple clincher. After staple clinching has occurred and with valve 72 still in the second state, controller 88 activates and temporarily opens to valve 90 atmosphere. The input port of valve 90 is coupled to chambers 74, 78 and 84 of housings 73, 75 and 77 respectively so as to permit the clincher, clamper and driver to return to their initial positions permitting the next stapling operation to commence when valve 72 is returned the first state by controller 88.

With continued reference to FIG. 2, the sheets are clamped to one another by coaxially joined cylindrical members 92 and 94. These members support a piston 96 and a cap 98 used to press diaphragm 80 against the face of piston 96. Cylindrical member 92 is slidably engaged and supported by a wall which defines a hole in a unit 100. Cylindrical member 94 is slidably engaged and supported by a wall which defines a hole in unit 102. Diaphragm 80 is clamped between units 100 and 102 by suitable fasteners. As a result, housing 75 defined by units 100 and 102 is divided by diaphragm 80 into two chambers 104 and 78. Piston 96 includes a recess which cooperates with boss 106 on unit 102 so that a compression spring 108 located about member 94 maintains cap 98 biased against unit 100 when substantially equal pressures are present in chambers 78 and 104. Unit 100 is connected to frame 66 with members 92 and 94 extending in a direction normal to the work station on head 68. Member 94 supports a clamp assembly, i.e., a piston 82 disposed over sheets 64. Chamber 78 is coupled to the output port of valve 72 by conduit 111. Thus, when valve 72 is moved into the first state by controller 88, pressurized air from accumulator 70 enters chamber 78. The pressurized air acts on diaphragm 80 and moves the clamping assembly, i.e., piston 82 into engagement with sheets 64. During this motion, a vent allows air in chamber 104 to exit and spring 108 is compressed. It should be noted that spring 108 returns piston 82 to its original position when the pressurized air is exhausted from chamber 78. The system for driving staples in head 68 through the clamped sheets 64 includes a piston 112 and a cap 114 fixed by a screw 116 to piston 112. Cap 114 is used to press diaphragm 86 against the face of piston 112. Diaphragm 86 is also clamped between the unit 118 and unit 120. This divides housing 77 into chambers 84 and 123. Unit 120 is fixed to frame 66 and has an axis in common with unit 118. The common axis is aligned with the common axis of members 92 and 94. Piston 112 includes a skirt section which slidably engages unit 118 and a recess 122 which functions as a seat for the driver head of stapler 68. Conduit 124 couples chamber 84 with conduit 111 which, in turn, is connected to the input port of valve 72. In this way, pressurized air is transmitted to chamber 84 causing diaphragm 86 to expand actuating the driver of stapler 68 so as to drive a staple through stack of copy sheets 64.

The clinching mechanism includes a piston 126 with diaphragm 76 interposed between cap 125 and the backface of piston 126. Fastener 130 secures cap 125 and diaphragm 76 to piston 124. Diaphragm 76 defines chambers 74 and 130 in housing 73. In the second state, controller 88 closes the input port to valve 72. This permits the pressurized air to exhaust from chambers 84 and 78 into chamber 74. This moves the clinching mechanism down into engagement with the staple legs protruding from stack 64. The clinching mechanism bends or folds the legs into engagement with the stack securing the sheets thereof to one another. Spring 99 is employed to return cap 126 to its original position. After the clinching operation, controller 88 opens the output port of valve 90 to exhaust pressurized fluid via conduits 110, 111, 128 and 124 to atmosphere. This returns the clinching mechanism, clamping mechanism, and staple driver to their original positions for initiation of the next stapling operation.

Figure 3:
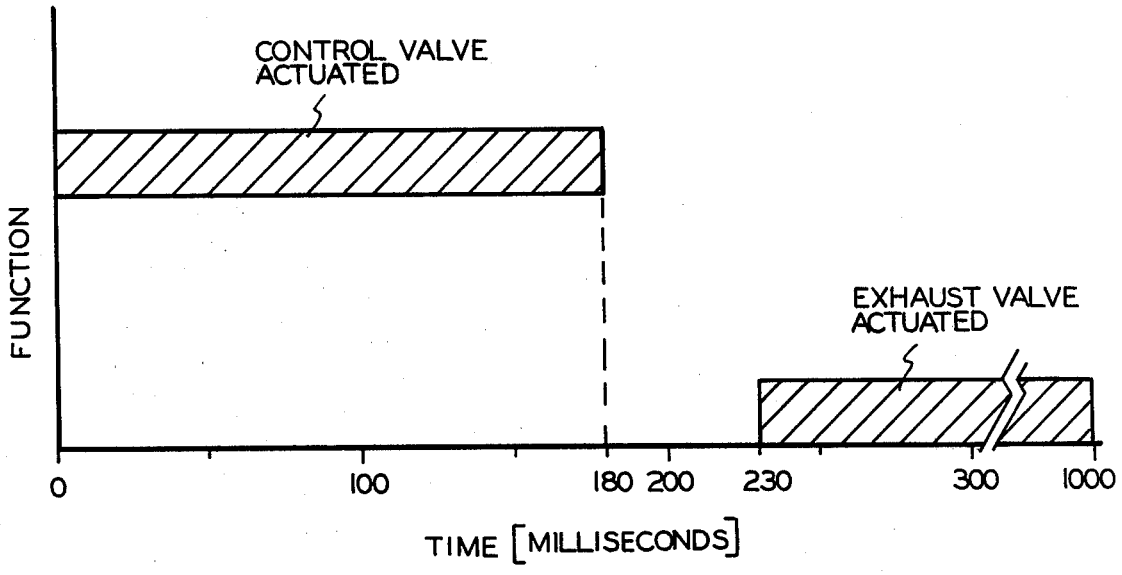
FIG. 3 is a timing diagram illustrating the operation of the FIG. 2 stapling apparatus.

Turning now to FIG. 3, there is shown the timing sequence for the stapling system. As shown therein, valve 72 is actuated for 180 miliseconds to couple accumulator 70 to the driving and clamping systems. In this way, staples are driven through the clamped stack of sheets. Valve 72 is actuated for a sufficiently long time duration to permit the pressure in the driving and clamping systems to equalize with the pressure in accumulator 70. Next, valve 72 is deactuated exhausting the air from the driving and clamping systems into the clinching system. Valve 72 remains deactuated for 50 milliseconds. This permits the pressurized air to exhaust from the driving and clamping mechanisms into the clinching mechanism so as to clinch the staple legs. Thereafter, normally closed valve 90 is opened for approximately 770 milliseconds to permit all of the systems to return to their initial state. It should be noted that although valve 72 is actuated for 180 milliseconds, only 140 milliseconds are required to drive the staple through the stack of sheets. The extra 40 milliseconds permit the system to achieve equilibrium.

By way of example, controller 88 may be a switching mechanism associated with a suitable timer.

In recapitulation, it is evident that the stapling apparatus of the present invention employs a pressurized fluid to clamp the stack of sheets. Thereafter, the pressurized fluid drives a staple through the clamped stack of sheets. The pressurized fluid employed to clamp the sheets and drive the staple therethrough is then exhausted to a clinching mechanism which is actuated thereby to fold the staple legs into engagement with the sheets forming a booklet. In this manner, a collated set of sheets may be secured to one another forming a booklet thereof.

It is, therefore, evident that there has been provided, in accordance with the present invention, a stapling apparatus that fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A method of stapling at least two sheets to one another, including the steps of:
   applying a pressurized fluid to a staple driver so as to force a staple through the sheet; and
   exhausting the pressurized fluid from the staple driver to a staple clincher so as to clinch the portion of the staple legs protruding through the sheets.

2. A method as recited in claim 1, further including the steps of:
   applying the pressurized fluid to a staple clamper so as to secure the sheets stationarily as the staple legs pass through the sheets; and
   exhausting the pressurized fluid from the staple clamper to the staple clincher so as to clinch the portion of the staple legs protruding through the sheets.

3. An apparatus for stapling at least two sheets to one another, including:
   means for driving a staple through the sheets;
   means for clinching the portion of the staple legs protruding through the sheets;
   a source of pressurized fluid; and
   control means for placing said pressure source in communication with said driving means to actuate said driving means, said control means placing said clinching means in communication with said driving means so that the fluid exhausting therefrom activates said clinching means.

4. An apparatus as recited in claim 3, further including means for clamping the sheets to one another, said control means placing said clamping means in communication with said pressure source to actuate said clamping means and placing said clinching means in communication with said clamping means so that the fluid exhausting therefrom actuates said clinching means.

5. An apparatus as recited in claim 4, wherein pressure source, a second port connected to said driving means and said clamping means, and a third port connected to said clinching means; and
   switching means for selectively opening and closing the ports of said valve.

6. An apparatus as recited in claim 5, wherein said clinching means include:
   a housing having an interior chamber;
   a diaphragm disposed in the chamber of said housing to divide the chamber of said housing into a first chamber and a second chamber with the first chamber being connected to the third port of said valve so that exhaust fluid from said driving means and said clamping means expands said diaphragm; and
   means, actuated by the expansion of said diaphragm, for bending the portion of the staple legs protruding through the sheets into contact therewith.

7. An apparatus as recited in claim 5, wherein said clamping means include:
   means for supporting the sheets;
   a piston;
   means for resiliently urging said piston to a position spaced from the sheet;
   a housing having an interior chamber;
   a diaphragm disposed in the chamber of said housing to divide the chamber of said housing into a first chamber and a second chamber with the first chamber being connected to the second port of said valve so that pressurized fluid from said pressure source expands said diaphragm, said diaphragm contacting said piston and moving said piston into engagement with the sheets to clamp the sheets during the expansion thereof.

8. An apparatus as recited in claim 5, wherein said driving means include:
   a stapling head; and
   a housing having an interior chamber; and
   a diaphragm disposed in the chamber of said housing to divide the chamber of said housing into a first chamber and a second chamber with the first chamber being connected to the second port of said valve so that the pressurized fluid expands said diaphragm to actuate said stapling head driving a staple through the sheets.

9. A reproducing machine for producing stapled piles of copies from documents advancing from a supply source to an exposure platen and then returning to the supply source in repeated cycles with the copies being stapled in sets corresponding to the set of documents being copied, wherein the improved stapling apparatus includes:
   means for driving a staple through a copy set;
   means for clinching the portion of the staple legs protruding through the copy set;
   a source of pressurized fluid; and
   control means for placing said pressure source in communication with said driving means to actuate said driving means, said control means placing said clinching means in communication with said driving means so that the fluid exhausting therefrom actuates said clinching means.

10. A reproducing machine as recited in claim 9, further including means for clamping the sheets of the copy set to one another, said control means placing said clamping means in communication with said pressure source to actuate said clamping means and placing said clinching means in communication with said clamping means so that the fluid exhausting therefrom actuates said clinching means.

11. A reproducing machine as recited in claim 10, wherein said control means include;
   a valve with a frist port connected to said pressure source, a second port connected to said driving means and said clamping means, and a third port connected to said clinching means; and
   switching means for selectively opening and closing the ports of said valve.

12. A reproducing machine as recited in claim 11, wherein said clinching means include:
   a housing having an interior chamber;
   a diaphragm disposed in the chamber of said housing to divide the chamber of said housing into a first chamber and a second chamber with the first chamber being connected to the third port of said valve so that exhaust fluid from said driving means and said clamping means expands said diaphragm; and means, actuated by the expansion of said diaphragm, for bending the portion of the staple legs protruding through the sheets into contact therewith.

13. A reproducing machine as recited in claim 11, wherein said clamping means include:

means for supporting the sheets of the copy set;

a piston;

means for resiliently urging said piston to a position spaced from the sheets of the copy set;

a housing having an interior chamber;

a diaphragm disposed in the chamber of said housing to divide the chamber of said housing into a first chamber and a second chamber with the first chamber being connected to the second port of said valve so that pressurized fluid from said pressure source expands said diaphragm, said diaphragm contacting said piston and moving said piston into engagement with the sheets to clamp the sheets during the expansion thereof.

14. A reproducing machine as recited in claim 11, wherein said driving means include:

a stapling head;

a housing having an interior chamber; and a diaphragm disposed in the chamber of said housing to divide the chamber into a first chamber and a second chamber with the first chamber being connected to the second port of said valve so that the pressurized fluid expands said diaphragm to actuate said stapling head driving a staple through the sheets.

* * * * *